US005289792A

United States Patent [19]

Forrest et al.

[11] Patent Number: 5,289,792

[45] Date of Patent: Mar. 1, 1994

[54] SPINNAKER SAIL FOR KAYAKS, CANOES OR OTHER SMALL WATERCRAFT

[76] Inventors: Sara M. Forrest, 139 Tuscaloosa Ave., Atherton, Calif. 94025; James L. Vermillion, HC78 Box 2425, Chugiak, Ak. 99567-9609

[21] Appl. No.: 500,744

[22] Filed: Mar. 28, 1990

Related U.S. Application Data

[63] Continuation of Ser. No. 55,943, Jun. 1, 1987, Pat. No. 4,958,582.

[51] Int. Cl.[5] ..... B63H 9/04

[52] U.S. Cl. ..... 114/102; 114/39.1

[58] Field of Search ..... 114/90, 91, 102–105, 114/108–115, 39.1

[56] References Cited

U.S. PATENT DOCUMENTS

| | | | |
|---|---|---|---|
| 2,595,110 | 4/1952 | Steube et al. | 114/108 |
| 3,207,114 | 9/1965 | Moseley et al. | 114/102 |
| 3,828,711 | 8/1974 | Russell | 114/103 |
| 4,016,823 | 4/1977 | Davis | 114/90 |
| 4,047,492 | 9/1977 | Brown | 114/39.1 |
| 4,296,704 | 10/1981 | Bridge | 114/103 |

FOREIGN PATENT DOCUMENTS

| | | | |
|---|---|---|---|
| 2275358 | 1/1976 | France | 114/102 |
| 717423 | 10/1954 | United Kingdom | 114/102 |
| 1171577 | 11/1969 | United Kingdom | 114/102 |

*Primary Examiner*—Jesus D. Sotelo

*Attorney, Agent, or Firm*—Christensen, O'Connor, Johnson & Kindness

[57] ABSTRACT

An improved spinnaker sail for use with kayaks, canoes, or other small watercraft is disclosed. The spinnaker is designed with a free backstay feature that eliminates moment forces on the mast. A telescoping mast is also disclosed to allow one-person set up when on the ocean. The spinnaker is also controlled by a single sheet, which attaches to the lower corners of the spinnaker, forming a loop. The loop can then be held under the arms to allow the hands to be free. The spinnaker can also be reefed to 50 percent of its total area by changing the sheet configuration.

5 Claims, 6 Drawing Sheets

SPINNAKER SAIL FOR KAYAKS, CANOES OR OTHER SMALL WATERCRAFT

This is a continuation of the prior application Ser. No. 055,943, filed Jun. 1, 1987, now U.S. Pat. No. 4,958,582, the benefit of the filing date of which is hereby claimed under 35 USC 120.

BACKGROUND OF THE INVENTION

This invention relates to a sail for small watercraft, and more particularly, to sails for kayaks and canoes. Kayaks and canoes have been used for water transportation for hundreds of years. Traditionally, these craft have been designed for one- or two-man crews, using paddles for propulsion. Sailing craft have also been used for several thousands of years. However, sails usually require more than one person to handle them effectively. Also, due to sometimes large bending moments, masts were large and were designed to be locked into place, making quick installation and removal while in the water difficult.

The present invention overcomes these difficulties. It consists of a spinnaker, a mast, and the fittings that secure the mast and the sail to the watercraft. One innovation in this design is the use of a free backstay. By not connecting the backstay to the mast, all bending moments are removed from the mast. The mast is only subjected to compressional forces when the sail is in use. Another innovation is a design to allow fast reefing of the sail. By changing the configuration of three clips, the sail area can be reduced by 50 percent. Thus, the sail design provides a great deal of control without a lot of difficult manipulation of the sail. Finally, the mast telescopes, which allows for quick erection and retraction without a lot of movement. The mast components are also connected with an internal shock cord to prevent loss of the individual mast components.

It is an object of this invention to produce a spinnaker sail for kayaks or canoes that has a free backstay.

It is another object of this invention to produce a telescoping mast system that can be erected and retracted quickly and easily.

It is yet another object of this invention to provide a system to reef the spinnaker with a minimum of movement or effort.

DESCRIPTION OF THE PREFERRED EMBODIMENT

Figure 1:
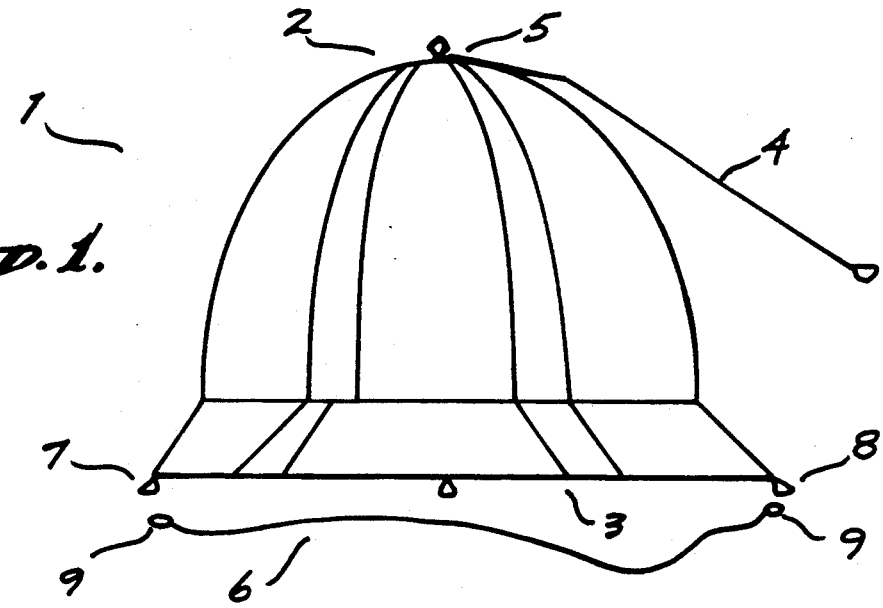
FIG. 1 is a front view of the sail, showing the main components.
Figure 2:
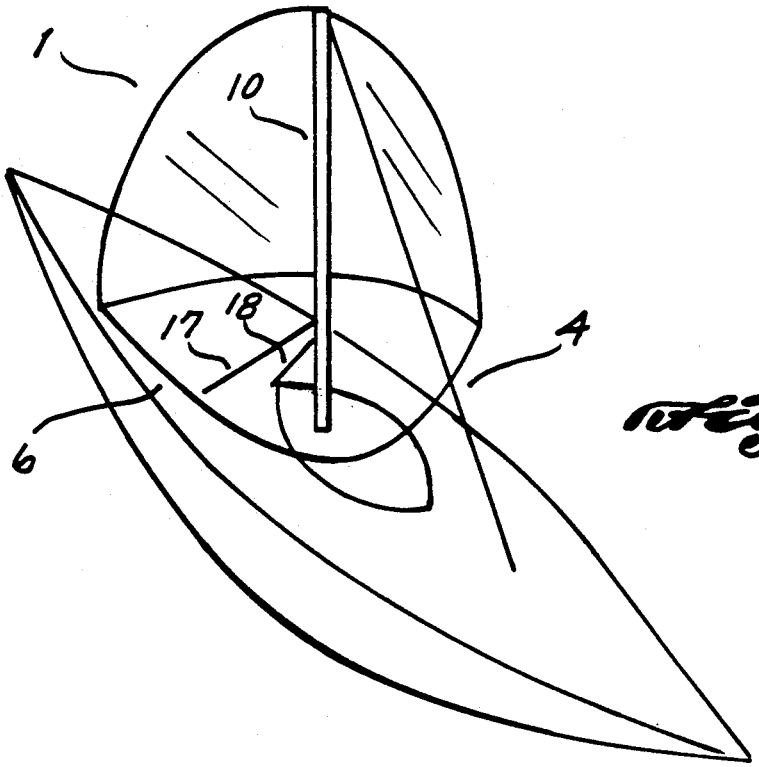
FIG. 2 is a perspective view of a typical kayak with the sail installed.

Referring now to the drawing figures, and more particulary to FIGS. 1 and 2, the invention consists of a sail 1 having a head 2 and a foot 3. The sail 1 is generally triangular in shape, being narrow at the head 2 and wide at the foot 3. The backstay line 4 is attached to the head 2 at a grommet 5 as shown. A single sheet 6 is provided, attached permanently to the foot 3 adjacent foot clip 7. The sheet 6 is fitted with a sheet clip 9, which is used to fasten the sheet 6 temporarily to the foot 3 by foot clip 8*a* or, alternately by foot clip 8*b* as shown. The single sheet 6 allows the line to be placed around the front of the mast 10 and hand-held for use, eliminating the possibility of the craft being overturned by any sudden gust of wind. When the single sheet 6 is released, the sail 1 simply streams away from the mast 10, flying like a windsock above the kayak or canoe. The single sheet 6 also provides an easy method of retrieving the sail 1 for initial use or after it has been released for safety following a sudden gust of wind. The single sheet 6 further provides an easy method of orienting the sail 1 for use, as this follows naturally whenever the single sheet 6 is pulled to hand by the user and the hands spread to open the spinnaker. This is functionally superior to the use of separate sheets, which must be individually retrieved and untangled prior to opening the sail 1. The use of a single sheet 6 also eliminates the need to restrain the sheets while the mast 10 is being extended. The sheet 6 can also be cut into two separate lines, or can be installed as two separate lines initially.

Figure 6:
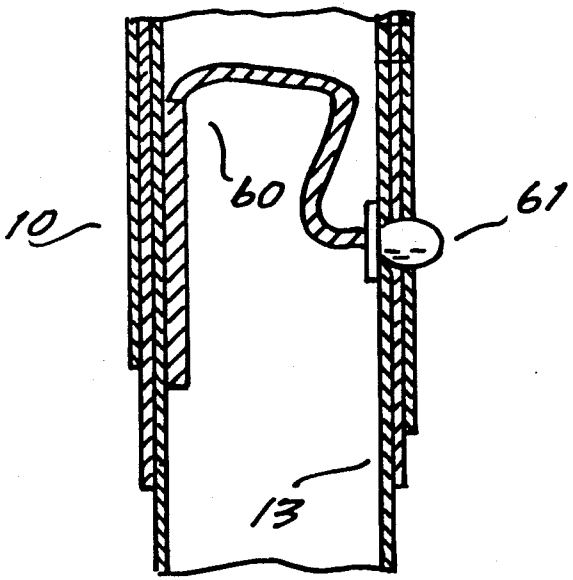
FIG. 6 is a detail of the mast extension locking clip.
Figure 5:
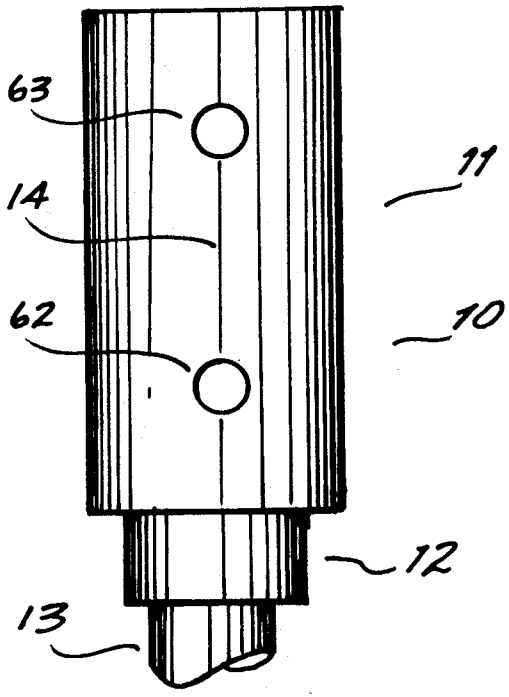
FIG. 5 is a detail of the mast assembly showing the telescoping sections.

Referring now to FIG. 5, the mast 10 is formed of three tubing pieces, 11, 12, and 13. The mast 10 is assembled by sliding tube 13 into tube 12 and then sliding the combination into tube 11 as shown. The mast 10 has four different height adjustments to allow for wind conditions and the height of the user. The mast 10 has guide lines 14 to ensure that the three tubes are properly aligned to permit the locking of the mast tubes in place. Referring now to FIGS. 5 and 6, the mast 10 is locked into place by a spring clip locking mechanism. The mechanism consists of two arched spring clips 60 that are fastened to the inside surfaces of the tubes 12 and 13. The spring clips 60 are held in place by their own tension. Plunger ends 61 are attached to the ends of each spring clip 60. Holes 62 and 63 are provided in the wall of each tube 11, 12, and 13 to allow the plunger ends 61 to protrude through the walls of tubes 11, 12, and 13. Holes 62 and 63 are provided in the walls of the tubes 11, 12, and 13 to allow four different heights for the mast 10. The plunger ends 61 are designed to fit in the alignment holes 62 or 63. In use, the plunger ends 61 are restrained within the tubes. As the mast tubes are extended, the plunger ends 61 become aligned with the holes, either 62 or 63, and the plunger ends 61 extends through the hole, either 62 or 63, and the mast tube is locked into place. To retract the mast tube, the plunger end 61 is pushed into the mast tubes through both exit holes, and the mast tube is slid down until the plunger end 61 is restrained within the outer mast tube.

A bungee cord assembly 15 is attached to tube 11 as shown. A spacer 16 is also provided to prevent the cord 15 from sliding down the mast when it is under load.

The bungee cord assembly 15 has a left cord 17 and a right cord 18. Two clips 19 are attached to the cords 17 and 18. These clips are used to connect the cords 17 and 18 to deck fittings, described in greater detail below.

Figure 4:
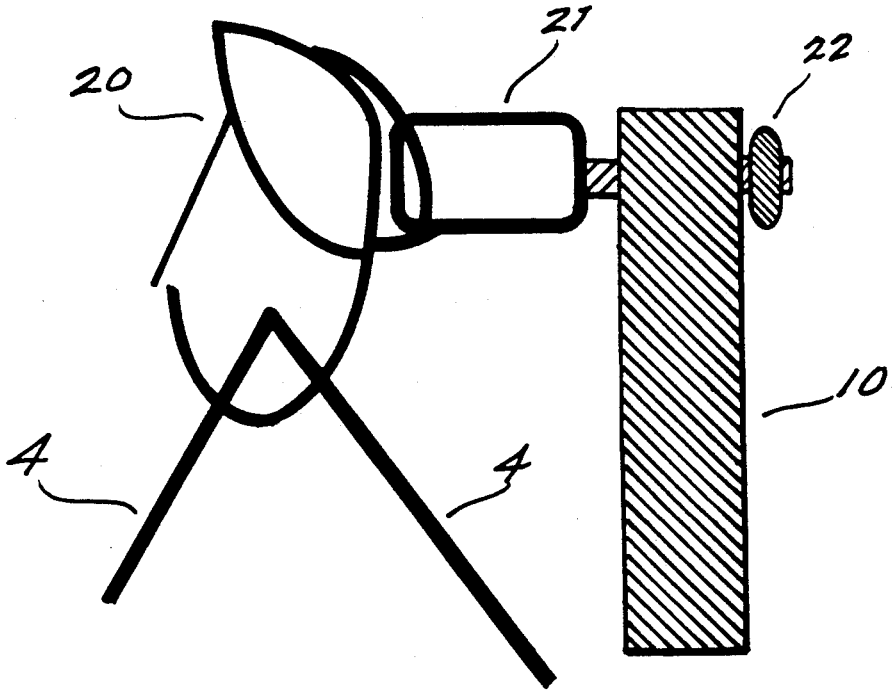
FIG. 4 is a detail of the mast top showing the free backstay feature.

The mast head is also fitted with a spring clip 20. The spring clip is used to clip the backstay line 4 to the mast 10. The backstay line is not fixed to the mast 10, but rather passes through the spring clip 20 as shown in FIG. 4. The spring clip 20 is fastened to the mast 10 by means of an eye bolt 21 and a nut 22. The eye bolt 21 passes through the mast tube 13. A shock cord 50 is fastened to the eye bolt 21 inside of tube 13. The shock cord 50 extends through the length of the tubes and is secured at the bottom of the mast by tying it to a plastic end cap 23.

Figure 3:
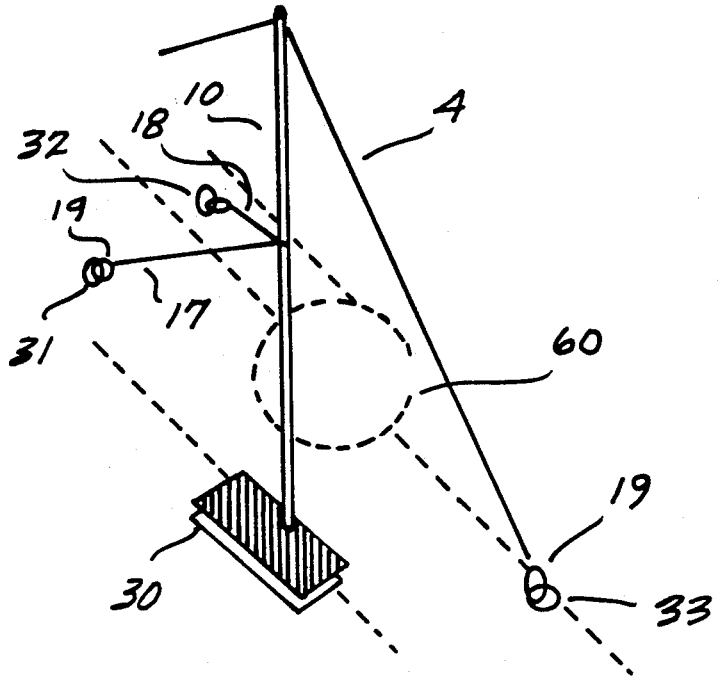
FIG. 3 is a detail view of the mast installation in a kayak or canoe.

Referring now to FIG. 3. A foam block 30 is placed on the inside bottom of the craft, centered over the keel. In the case of a kayak, the foam block is set so that the the mast 10 will extend through the cockpit. In the case of a canoe, the foam block is set so that the mast 10 will be supported by a thwart.

Referring now to FIG. 3, the bungee cords 17 and 18 fasten to the deck of a kayak by clipping the clips 19 to deck fittings 31 and 32. The backstay line 4 is also clipped to the deck at fitting 33. The backstay line 4 is also clipped to the deck fittings by a clip 19.

FIG. 2 shows the sail and mast fully installed, showing all connections to a typical kayak.

Figure 8A:
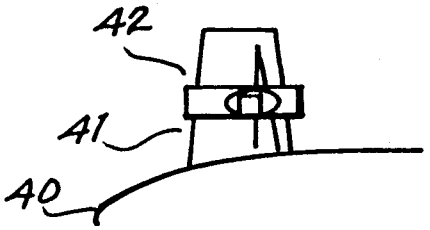
FIG. 8*a* is a detail of the modifications to the spray deck.
Figure 8B:
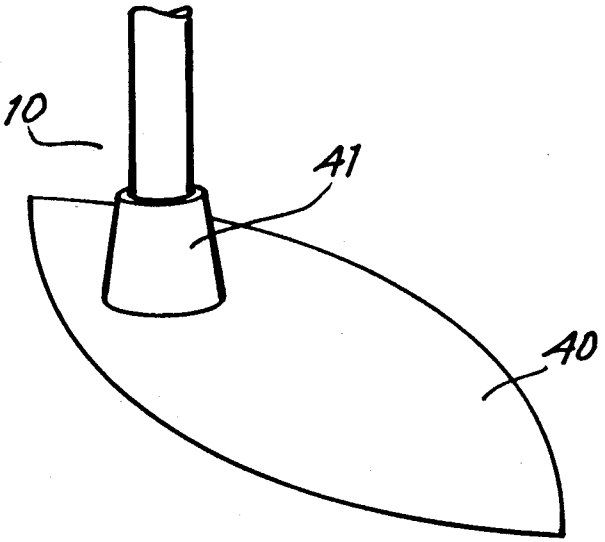
FIG. 8*b* is a detail of the mast spray-deck extension when not in use.
Figure 10:
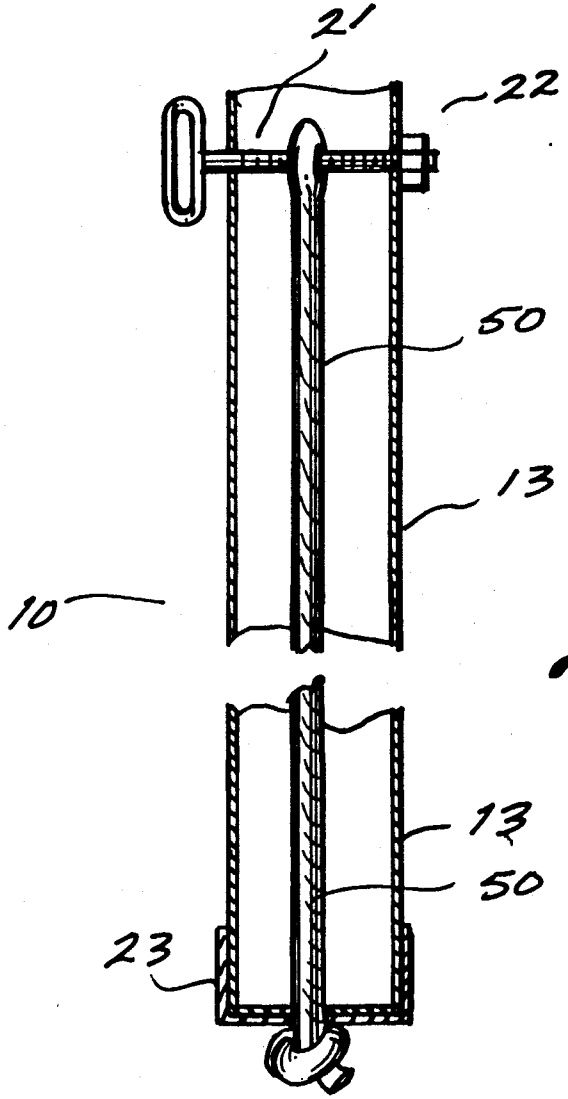
FIG. 10 is a detail view of the shock cord assembly that is installed within the mast.

To prevent water from filling a kayak, a spray deck 40 is used to seal the cockpit. A spray deck is commonly a neoprene rubber or coated NYLON TM cover. In order to accommodate the mast 10, the spray deck 40 must be modified. FIG. 8*a* shows the modification of the spray deck with the mast 10 installed and FIG. 8*b* shows the spray deck sleeve 41 when not in use. The modification consists of installing a sleeve 41 into the spray deck 40. The sleeve 41 is placed through a hole cut into the spray deck 40 that is sized to hold the mast 10. The sleeve is glued in place with suitable cement for the material. When the sail is not used the sleeve 41 is tied with a belt 42 as shown in FIG. 8*a*. To install the mast 10, the belt 42 is removed and the sleeve 41 is opened to receive the mast 10 as shown in FIG. 8*b*.

To install the sail in a canoe, the foam block 30 is placed on the inner surface of the canoe as in the case of the kayak. The deck fittings, however must be located in different areas, since a canoe does not have a top deck. Therefore, the deck fittings will be typically installed on the canoes gunwales. The bungee cords 17 and 18, and the backstay line 4 are then positioned to accommodate the different locations of the deck fittings.

Figure 9:
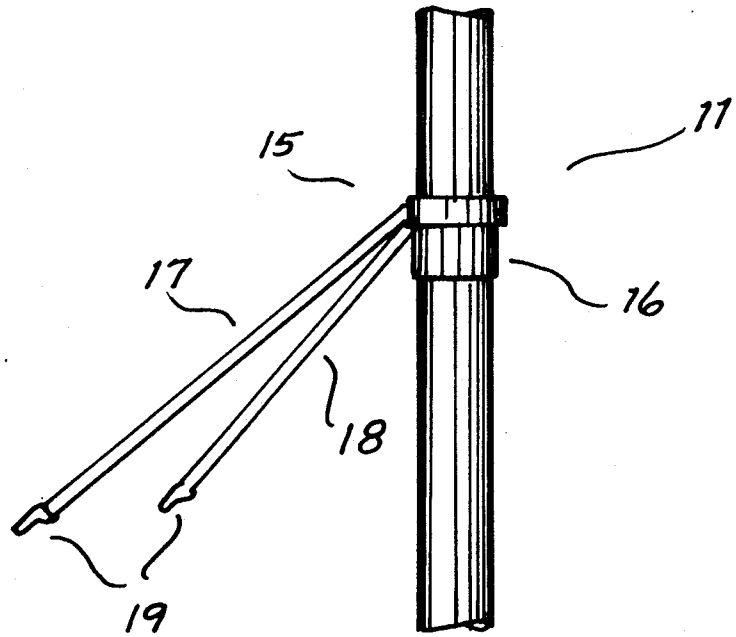
FIG. 9 is a detail of the mast anchor assembly.

To use the sail, the mast 10 is placed through the sleeve of the spray deck 40 into the foam block 30. In the case of a canoe or other small craft that do not use spray decks, the mast 10 is simply placed into the foam block 30. The mast bungee cords 17 and 18 are then clipped onto the deck fittings 31 and 32, as shown in FIG. 9. The backstay 4 is then fastened into place behind the paddler on fitting 33 and the backstay 4 is then clipped into place through the spring clip 20 on the mast head. The mast can then be raised to its working height. As the mast is raised, the sail will extend along the mast and at the user's option may be restrained or freed. After the mast has been extended, the user grasps the sheet 6 and extends the hands to the sides to inflate the sail for use. As discussed above, the use of a single sheet makes erection of the mast simpler as the user need not keep the sheets untangled or even restrained.

Figure 7B:
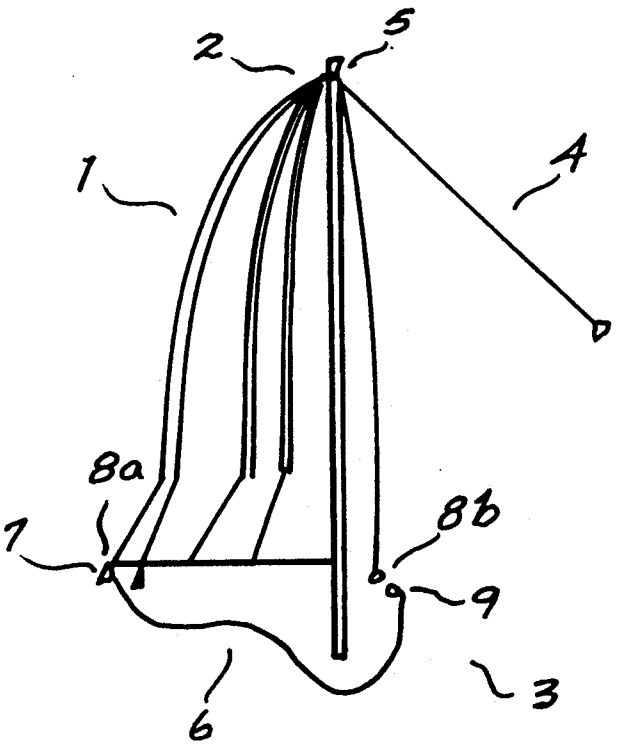
FIG. 7*b* is a detail of the clip arrangement showing the sail at a 50% reef.
Figure 7A:
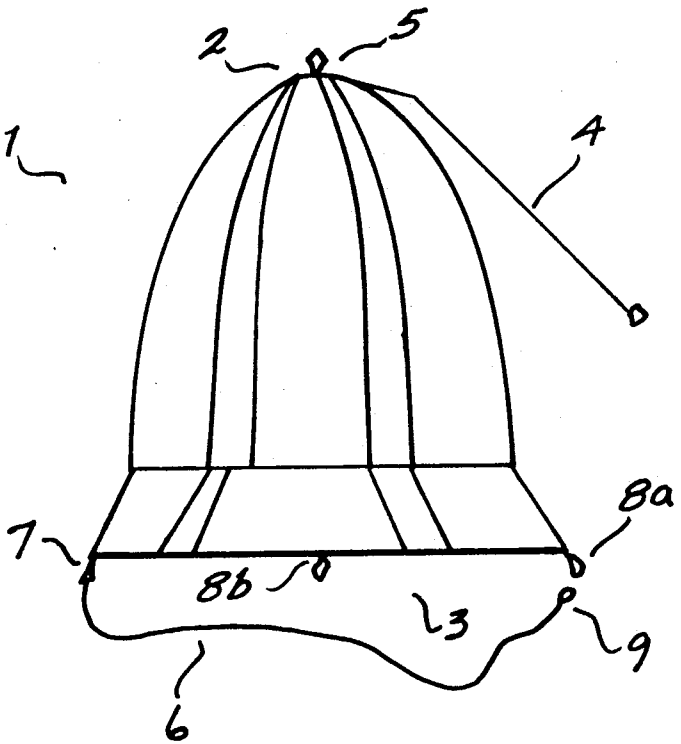
FIG. 7*a* is a detail of the clip arrangement showing the full sail configuration.

Referring now to FIGS. 7*a* and 7*b*, the sail 1 can be reefed by detaching the sheet clip 9 from the foot clip 8*a*, then bringing the foot clip 8*a* over to the opposite side and attaching foot clip 8*a* to foot clip 7, the sheet clip 9 is then attached to foot clip 8*b* and the sail 1 is again ready for use, now being reduced in area by 50%.

The sail-mast assembly can be readily retracted by simply retracting the mast 10. Once the mast is fully retracted, the backstay 4 and the mast can be unclipped from the deck and quickly removed and stored within the watercraft.

While under sail, the kayak or canoe can be steered with either a paddle or a built-in rudder.

It is intended that the present disclosure should not be construed in any limited sense other than that limited by the scope of the claims, having regard to the teachings herein and the prior art being apparent with the preferred form of the invention disclosed herein and which reveals details of structure of a preferred form necessary for a better understanding of the invention and may be subject to modification by skilled persons within the scope of the invention without departing from the concept thereof.

I claim:

1. A spinnaker sail having a top and a bottom, said sail being generally triangular and being configured with the base of the triangle at the bottom of the spinnaker sail, in combination with a mast; for use in kayaks and small watercraft, said craft having a gunwale, wherein the improvement comprises:

a backstay, fixedly attached to the top of said sail, extending outwardly therefrom to said mast where said backstay is slidably attached to said mast, and being quickly installed thereon or removed therefrom without disassembly of said mast, and extending downwardly therefrom to said gunwale and being removably attached to said gunwale of said watercraft; and clip means attached to said mast to permit the fast installation and removal of the backstay from said mast without disassembling said mast.

2. The device of claim 1, wherein said mast is removably attached to said watercraft.

3. The device of claim 1, wherein said mast is telescoping.

4. The device of claim 1, further comprising a sheet, fixedly attached to a first corner of said bottom of said sail and also being removably attached to a second corner of said bottom of said sail, said sheet generally forming a loop.

5. A system for use with a sail and backstay on a small watercraft comprising:

a mast;

anchor means to removably secure said mast to the watercraft; and clip means for slidably fastening the backstay to said mast.

* * * * *